United States Patent [19]

Gearhart

[11] 4,278,529

[45] Jul. 14, 1981

[54] PROCESS FOR SEPARATING BITUMINOUS MATERIALS WITH SOLVENT RECOVERY

[75] Inventor: Junior A. Gearhart, Oklahoma City, Okla.

[73] Assignee: Kerr-McGee Refining Corporation, Oklahoma City, Okla.

[21] Appl. No.: 164,591

[22] Filed: Jun. 30, 1980

[51] Int. Cl.[3] ..... C10C 3/00; C10C 3/08

[52] U.S. Cl. ..... 208/309; 208/321

[58] Field of Search ..... 208/45, 309, 321

[56] References Cited

U.S. PATENT DOCUMENTS

| | | | |
|---|---|---|---|
| 2,041,275 | 5/1936 | Bray | 208/309 |
| 2,940,920 | 6/1960 | Garwin | 208/45 |
| 3,403,093 | 9/1968 | Mills | 208/45 |
| 3,830,732 | 8/1974 | Gatsis | 208/309 |
| 3,847,751 | 11/1974 | Godino | 208/309 |
| 4,017,383 | 4/1977 | Beavon | 208/309 |
| 4,101,415 | 7/1978 | Crowley | 208/45 |
| 4,125,459 | 11/1978 | Garwin | 208/309 |

*Primary Examiner*—Brian E. Hearn

*Attorney, Agent, or Firm*—William G. Addison

[57] ABSTRACT

A process for separating a solvent from a bituminous material by pressure reduction without carry-over of bituminous material. The fluid-like phase comprising bituminous material and solvent is reduced in pressure by passage through a pressure reduction valve and introduced into a steam stripper. The pressure reduction vaporizes part of the solvent and also disperses a mist of fine bituminous particles in the solvent. The solvent and mist are withdrawn from the steam stripper and introduced into a separation zone wherein they are caused to flow countercurrently to another stream of fluid-like bituminous material. The fluid-like bituminous material contacts the solvent and scrubs the fine bituminous material particles therefrom. The solvent is withdrawn and recovered. The fluid-like stream containing the bituminous particles can be recycled until the concentration is such that additional particles are not separated from the solvent after which a portion is bled off and fresh fluid-like material is added.

15 Claims, 5 Drawing Figures

PROCESS FOR SEPARATING BITUMINOUS MATERIALS WITH SOLVENT RECOVERY

BACKGROUND OF THE INVENTION

1. Field of the Invention

This invention relates to a improved process for separating bituminous materials into various fractions employing solvents at elevated temperatures and pressures.

2. Brief Description of the Prior Art

Many methods for extracting various fractions from bituminous materials have been disclosed previously in the prior art, perhaps the most well known of these being termed "propane extraction" in which asphaltic materials are extracted or recovered from heavy hydrocarbon materials such as reduced crudes by means of a single solvent extraction step using propane as the extractant.

U.S. Pat. No. 2,940,920, assigned to the same asssignee as the present invention, discloses that solvents other than propane can be used to separate heavy hydrocarbon materials into at least two fractions at a greatly improved rate of separation and in a manner which eliminates certain prior art operating difficulties encountered in the use of propane type solvents ($C_2$ to $C_4$ hydrocarbon solvents). That patent discloses effecting the separation by using high temperature-pressure techniques and by using pentane as one of a group of suitable solvents. Such practice permits a deeper cut to be made in the heavy hydrocarbon material.

U.S. Pat. No. 4,125,459, assigned to the same assignee as the present invention, discloses a process for separating a heavy hydrocarbon material into three fractions by using a combination of propane and pentane deasphalting techniques. That process includes (i) mixing the heavy hydrocarbon material with pentane at elevated temperatures and pressures to produce a light fraction containing resins and oils, (ii) mixing the light fraction with propane at high temperatures and pressures to produce a second light fraction comprising oils and a second heavy fraction comprising resins and (iii) recycling at least a portion of the resins fraction back to the pentane deasphalting process. Alternatively, that process may be carried out by subjecting the heavy hydrocarbon material first to a propane deasphalting process to produce a heavy fraction containing asphaltenes and resins, followed by a pentane deasphalting process on the asphaltene-resin fraction previously obtained to produce a second light fraction comprising resins and a second heavy fraction comprising asphaltenes and recycling at least a portion of the resins fraction back to the propane deasphalting process.

U.S. Pat. No. 3,830,732 discloses a two solvent extraction process for producing three fractions from a hydrocarbon charge stock containing asphaltenes, resins and oils. The charge stock is admixed with a first solvent in a volumetric ratio of solvent to charge stock of less than about 4:1 to form a mixture that is introduced into a first extraction zone maintained at an elevated temperature and pressure. The mixture separates within the first extraction zone to produce a first solvent-rich liquid phase containing oils which are free of asphaltenes and resins and a first solvent-lean liquid phase containing asphaltenes and resins. The solvent-lean liquid phase then is contacted with a second solvent containing at least one more carbon atom per molecule than said first solvent and introduced into a second extraction zone. The second extraction zone is maintained at a lower temperature and pressure than the first extraction zone to separate the solvent-lean liquid phase into a second solvent-rich liquid phase containing resins and a second solvent-lean liquid phase containing asphaltenes.

U.S. Pat. No. 4,101,415 discloses a single solvent extraction process for separating a heavy hydrocarbon material into three different fractions by a process employing a two stage solvent treatment wherein different solvent to feed ratios and different temperatures are used in each stage. The charge stock is admixed with the solvent in a volumetric ratio of solvent to feed in the range of 2:1 to 10:1 and introduced into a first extraction zone maintained under temperature and pressure conditions sufficient to cause the mixture to separate into a first solvent-rich fraction containing oils and a first solvent-lean fraction containing asphaltenes and resins. The solvent-lean fraction then is contacted with an additional portion of the solvent and introduced into a second extraction zone maintained at a temperature and pressure lower than in the first extraction zone to cause asphaltic solids to form. The soluble material then is separated from the asphaltic solids.

In many of the prior art separation processes, the solvent is separated from the various products by either or both pressure reduction and steam stripping. The solvent is vaporized by such treatment, separated from the bituminous product and condensed for recycle in the separation process.

It has been observed that in some instances a portion of the bituminous material introduced into the steam stripping apparatus is carried out of the steam stripper in the form of fine particles with the vaporized solvent and steam. When the solvent and steam are condensed, the fine particles solidify and settle within the process apparatus. The settling solids ultimately plug the apparatus and cause a disruption in the operation of the bituminous separation process.

SUMMARY OF THE INVENTION

The discovery now has been made that it is possible to separate a solvent from a bituminous material by pressure reduction and steam stripping without carryover of fine particles of bituminous material into the solvent recovery apparatus.

Initially, a bituminous feed is admixed with a solvent and introduced into a separation zone. The separation zone is maintained at an elevated temperature and pressure to effect a separation of the mixture into a fluid-like light phase comprising light bituminous material and solvent and a fluid-like heavy phase comprising heavy bituminous material and solvent.

The heavy phase is withdrawn from the separation zone and reduced in pressure by passage through a pressure reduction valve. The reduction in pressure causes a substantial portion of the solvent in the heavy phase to vaporize. Unfortunately the pressure reduction also results in the formation of the undersired fine particle size mist of a portion of the heavy bituminous material. The vaporized solvent, fine particle size mist and fluid-like heavy bituminous material then is introduced into a steam stripper for separation of the non-vaporized solvent remaining in the fluid-like material. In the steam stripper, that solvent is vaporized by the steam. The resulting mixture consisting of the vaporized solvent, steam and fine particles of bituminous material rises to an upper portion of the stripper for withdrawal and introduction into a second separation zone.

The mixture is caused to flow through a pathway of extended length within the second separation zone. A portion of the light phase product is introduced into the second separation zone to countercurrently contact the mixture during its passage through the second separation zone to scrub the fine particles of bituminous material therefrom. The solvent vapor and steam then are withdrawn from the second separation zone and introduced into a solvent condenser. The solvent and steam are condensed and the resultant liquid stream is withdrawn from the solvent condenser and introduced into a solvent-water separator. The solvent is separated for recycle in the process and the water can be sewered.

The utilization of the second separation zone with countercurrent flow of a portion of light phase product to scrub the solvent eliminates the possibility of fine particle carry-over into the solvent condenser or solvent-water separator apparatus.

The light phase is withdrawn from the separation zone and introduced into a third separation zone for additional processing to recover a light phase product.

DESCRIPTION OF THE PREFERRED EMBODIMENT

Figure 1:
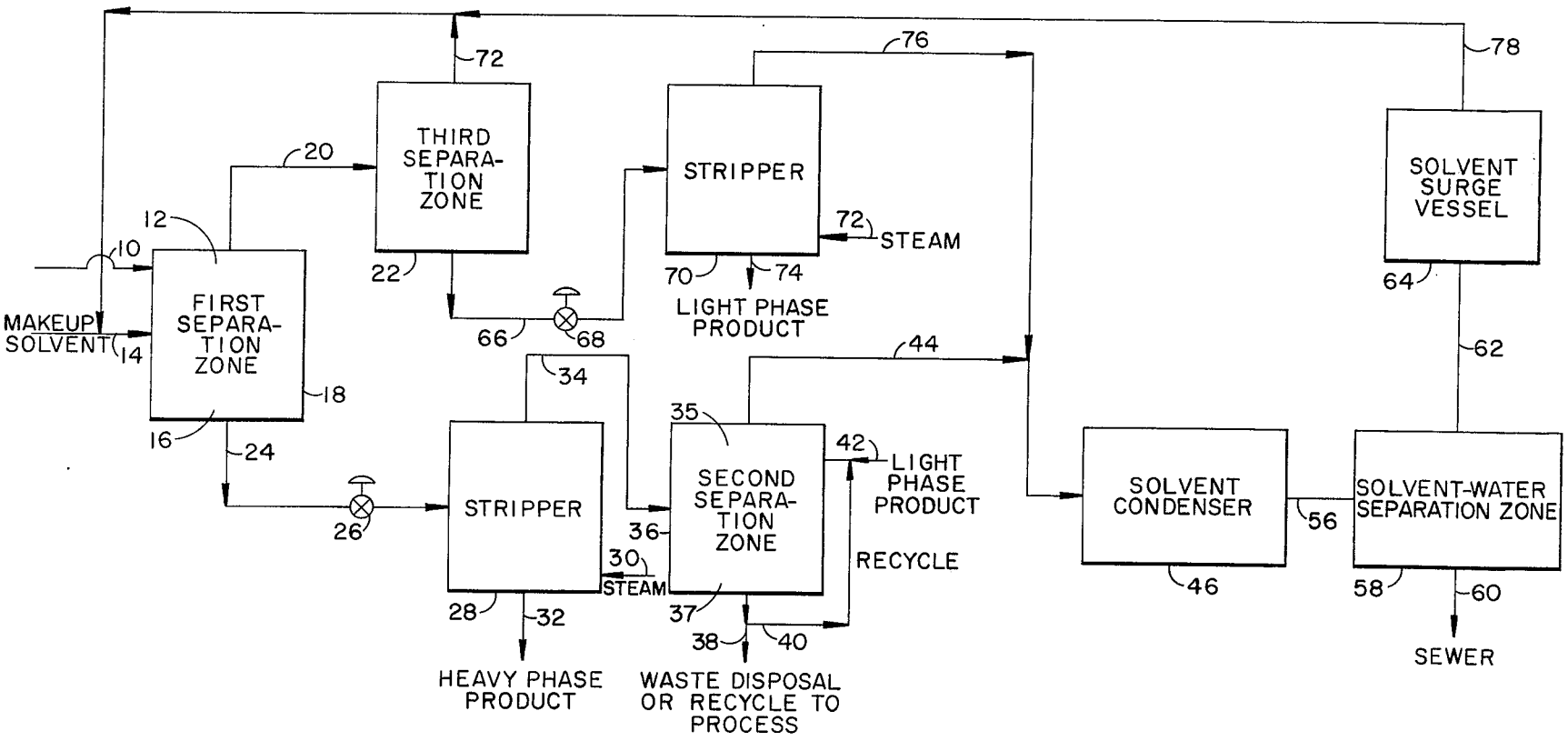
FIG. 1 is a diagrammatic illustration of the process of this invention.

Turning now to FIG. 1, one embodiment of the process of the present invention is illustrated. A feed comprising a bituminous material is introduced into a first separation zone 18 through a conduit 10. Preferably, the feed is introduced into an upper portion 12 of first separation zone 18. A solvent is introduced into first separation zone 18 through a conduit 14 to contact the feed. Preferably, the solvent is introduced into a lower portion 16 of first separation zone 18. Sufficient solvent is introduced into first separation zone 18 to provide a ratio of solvent to feed introduced therein in the range of from about 2:1 to about 20:1 and preferably in the range of from about 8:1 to about 12:1. It is to be understood that larger quantities of solvent may be used, but such use is unnecessary.

To facilitate an understanding of the process of the present invention, and not by way of limitation, hereinafter specific reference will be made to a bituminous feed comprising a vacuum residuum containing asphaltenes, resins and oils.

The first separation zone 18 is maintained at an elevated temperature and pressure to effect a separation of the vacuum residuum-solvent mixture into a fluid-like first light phase comprising oils and solvent and a fluid-like first heavy phase comprising asphaltenes, resins and some solvent.

More particularly, the first separation zone 18 is maintained at a temperature level in the range of from about 150 degrees F. to above the critical temperature of the solvent. The pressure level of first separation zone 18 is maintained at least equal to the vapor pressure of the solvent when zone 18 is maintained at a temperature below the critical temperature of the solvent and at least equal to the critical pressure of the solvent when maintained at a temperature equal to or about the critical temperature of the solvent.

In an alternate embodiment of the invention (not shown), the feed and solvent are introduced into a mixing zone prior to introduction into first separation zone 18. The solvent and feed are admixed in the volumetric ratio previously set forth to form a mixture. The mixture then is introduced into first separation zone 18 wherein the mixture is causd to separate into the fluid-like first light phase and the fluid-like first heavy phase.

Referring again to FIG. 1, the first heavy phase is withdrawn from first separation zone 18 through a conduit 24 and reduced in pressure by passage through a pressure reduction valve 26 interposed in conduit 24. Preferably, the pressure level of the first heavy phase is reduced to a level of from about 0 to 50 psig. The pressure reduction vaporizes a substantial portion of the solvent in the first heavy phase, however, a small quantity of solvent remains dissolved in the fluid-like mixture of asphaltenes and resins. It has been observed that the pressure reduction or flashing process which results in vaporization of the solvent also results in the formation of a fog or mist of fine particle size asphaltenes and resins. The particles are dispersed within the vaporized solvent such that they do not readily recombine with the fluid-like asphaltenes and resins.

The mixture of solvent vapor, asphaltene and resin mist and fluid-like asphaltenes and resins in conduit 24 resulting from the pressure reduction then is introduced into a steam stripper 28. Steam is introduced into the bottom portion of stripper 28 by a conduit 30. The asphaltenes and resins settle and collect in the bottom portion of steam stripper 28. The solvent vapor and fine particle size asphaltenes and resins rise to an upper portion in stripper 28. The steam rises upwardly through the settling asphaltenes and resins and causes at least a portion of any remaining solvent associated therewith to be vaporized. The asphaltenes and resins are withdrawn from the bottom portion of stripper 28 through a conduit 32 for recovery. The vaporized solvent, steam and fine particles size asphaltenes and resins are withdrawn from the steam stripper 28 through a conduit 34.

Previously, the fine particle size asphaltenes and resins dispersed in the vaporized solvent have been found to solidify in downstream equipment, particularly in the solvent condenser. The solids accumulate within the apparatus and ultimately plug the withdrawal conduits necessitating termination of process operation.

In accordance with the improved process of the present invention, the mixture of vaporized solvent, steam and fine particle size asphaltenes and resins is introduced into a second separation zone 36. The second separation zone 36 is designed in such manner that when the mixture is introduced therein it is caused to flow through a circuitous path within zone 36.

A portion of a light phase product comprising oils separated from the bituminous feed is introduced into an upper portion 35 of second separation zone 36 through a conduit 42 in such a manner that the light phase product flows counter-currently to the mixture to scrub the fine particle size asphaltenes and resins from the solvent. Preferably, the light phase is introduced in an amount sufficient to provide a ratio by weight of light phase to mixture of from about 1:10 to about 1:1.

The light phase product, including the asphaltene and resin particles, collects within a lower portion 37 of second separation zone 36 and is withdrawn through a conduit 38. The withdrawn stream in conduit 38 can be recycled to first separation zone 18 for re-treatment in the process, blended with a product of lower quality such that the value of the blended product would be improved or at least unaffected or transported to suitable waste disposal. At least a portion of the material in conduit 38 can be withdrawn through a conduit 40 for recycle to conduit 42 to contact additional solvent containing dispersed asphaltene and resin particles. Such recycle is advantageous in that it reduces the overall quantity of makeup light phase product required for the scrubbing process. The vaporized solvent and steam, substantially freed of fine particle size asphaltenes and resins are withdrawn from second separation zone 36 through a conduit 44 and introduced into a solvent condenser 46.

Figure 4:
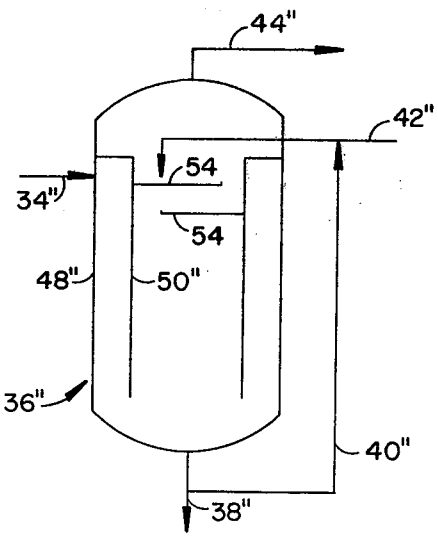
FIGS. 2, 3 and 4 are diagrammatic illustrations of apparatus suitable for use as the second separation zone.
Figure 3:
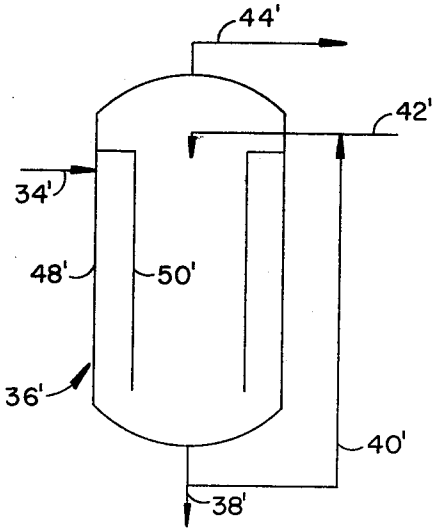
Figure 2:
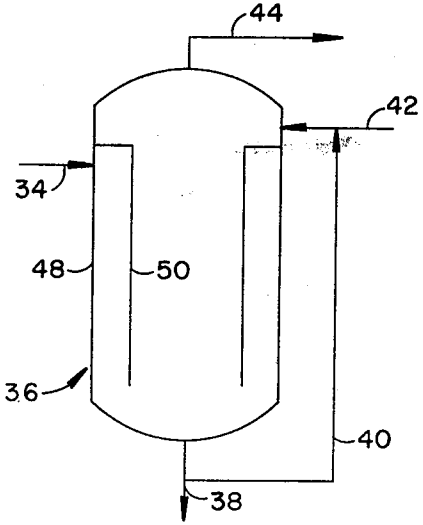

Turning now to FIGS. 2, 3 and 4, various apparatus suitable for effecting the removal of the fine particle size asphaltenes and resins are diagrammatically illustrated. In FIG. 2, separation zone 36 comprises a vessel 48 including a cylindrical interior section 50 designed to cause the mixture of vaporized solvent, steam and fine particle size asphaltenes and resins introduced into vessel 48 through line 34 to flow down the length of vessel 40 and flow back up through the interior of section 50 to exit the vessel through conduit 44. The light phase product is introduced through conduit 42 into the upper portion of section 50 and flows downward through the interior of section 50 countercurrently to the mixture of rising solvent, steam and fine particle size asphaltenes and resins. The light phase product contacts the mixture as it passes downwardly through vessel 48 to scrub the fine particles of asphaltenes and resins from the solvent. The light phase product collects in the lower portion of vessel 48 and the rate of withdrawal through conduit 38 is controlled to maintain the fluid level within vessel 48 below the lowermost portion of section 50.

In FIG. 3, vessel 48′ is illustrated including a jet nozzle 52 to ensure a uniform dispersion of the light phase product in section 50′.

In FIG. 4, vessel 48″ is provided with at least two trays 54 over which the light phase product flows within section 50″. The trays 54 can be provided with bubble-caps or any other similar devices to ensure efficient contact between the rising mixture of solvent, steam and fine particle size asphaltenes and resins with the downwardly falling light phase product to scrub the fine particles size asphaltenes and resins from the solvent.

Referring again to FIG. 1, in solvent condenser 46, the vaporized solvent and steam are condensed into a liquid mixture substantially free of any fine particle size asphaltenes and resins. The liquid mixture is withdrawn from solvent condenser 46 through a conduit 56 and introduced into a solvent-water separation zone 58.

In separation zone 58 the solvent is separated from the water and withdrawn through a conduit 62 for storage in a solvent surge vessel 64 and subsequent recycle in the process through a conduit 78. The separated water is withdrawn from separation zone 58 through a conduit 60 and can be sewered or disposed of in any other suitable manner.

The light phase formed in first separation zone 18 is withdrawn through a conduit 20 and introduced into a third separation zone 22.

In one particular embodiment, third separation zone 22 is maintained at a temperature level higher than the temperature level in the first separation zone 18 and at an elevated pressure to effect a separation of the first light phase into a third light phase comprising solvent and a fluid-like third heavy phase comprising oils and some solvent. The third light phase comprising solvent is withdrawn from the third separation zone 22 through a conduit 72 for recycle in the process. The third heavy phase is withdrawn through a conduit 66 for additional treatment.

The third separation zone 22 is maintained at a temperature level in the range of from about 25 degrees F. above the temperature level in the first spearation zone 18 to above the critical temperatures of the solvent. The pressure level of third separation 22 is maintained at least equal to the vapor pressure of the solvent when zone 22 is maintained at a temperature below the critical temperture of the solvent and at least equal to the critical pressure of the solvent when maintained at a temperature equal to or above the critical temerature of the solvent. The pressure level in the third separation zone 22 can be substantially the same pressure level as is maintained in first separation zone 18.

The third heavy phase in conduit 66 is reduced in pressure by passage through a pressure reduction valve 68 interposed in conduit 66. Preferably, the pressure level of the third heavy phase is reduced to a level of from about 0 to 50 psig. The pressure reduction vaporizes a substantial portion of the solvent remaining in the third heavy phase, however, a portion of the solvent remains in the third heavy phase. The third heavy phase then is introduced into a stripper 70. The oils in the third heavy phase separate from the vaporized solvent and collect in a lower portion of stripper 70. Steam is introduced into the lower portion of stripper 70 through a conduit 75. The steam rises through the oils to separate at least a portion of any solvent remaining associated with the oils. The oils then are withdrawn from stripper 70 through a conduit 74 for recovery as the light phase product. A portion of this product is used in the second separation zone 36 to scrub the fine particle size asphaltenes and resins from the vaporized solvent. The vaporized solvent and steam are withdrawn from stripper 70 through a conduit 76 and introduced into solvent condenser 46.

While, for simplicity, the solvent vapor and steam in conduit 76 has been described as introduced into solvent condenser 46 along with that in conduit 44 for solvent recovery, it is to be understood that separate solvent condensers and solvent-water separators can be used to recover the solvent from the respective streams.

In an alternate embodiment of the present invention, the feed is caused to separate within first separation zone 18 into a light phase comprising resins, oils and solvent and a heavy phase comprising asphaltenes and some solvent. The separation is effected by maintaining the temperature level and pressure level within first separation zone 18 at predetermined elevated temperatures and pressures. The particular conditions are selected to provide a solvent density within first separation zone 18 such that a fluid-like first heavy phase is caused to separate from the remaining solvent-rich first light phase.

The first heavy phase is withdrawn from first separation zone 18 through conduit 24 and treated as previously described to separate the solvent from the asphaltene product. Any fine particles of asphaltenes that form upon pressure reduction can be removed in second separation zone 36.

The first light phase is withdrawn from first separation zone 18 through conduit 20 and introduced into third separation zone 22. In third separation zone 22, the first light phase is caused to separate into a third light phase comprising solvent and a third heavy phase comprising resins and oils through control of the temperature and pressure within zone 22.

The third light phase comprising solvent is withdrawn and recycled as previously described.

The third heavy phase is withdrawn through conduit 66, reduced in pressure and introduced into stripper 70. In the event that pressure reduction of the third heavy phase results in the formation of fine particle size resins and oils in the vaporized solvent, the stream withdrawn through conduit 76 from stripper 70 can be introduced into conduit 34 for entry into second separation zone 36 rather than conduit 44 (not shown). Thus, any fine particle size resins and oils contained in the vaporized solvent can be removed prior to recovery of the solvent. The stream in conduit 76 also could be introduced into a separate separation zone (not shown) and then condensed for solvent recovery.

Figure 5:
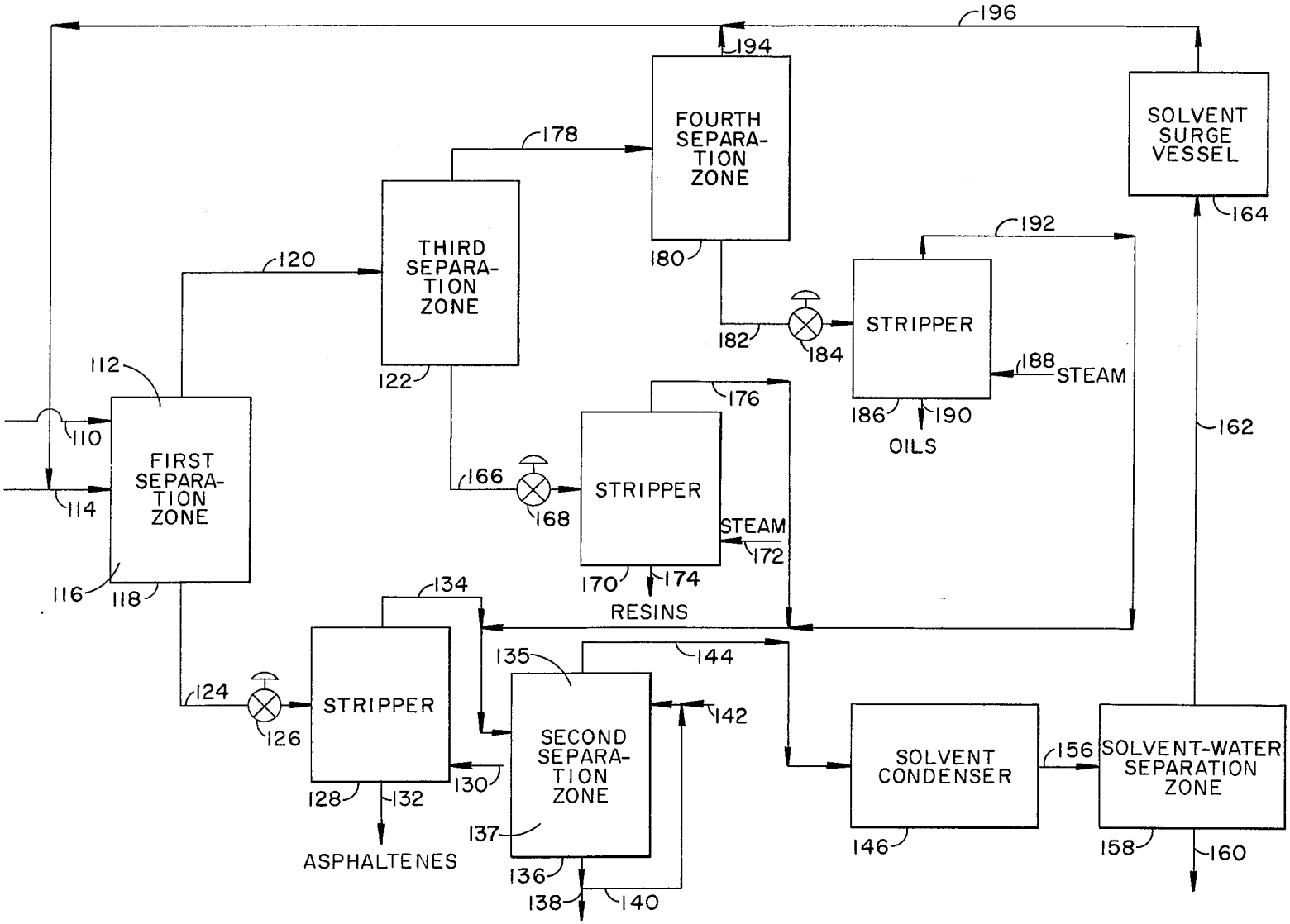
FIG. 5 is a diagrammatic illustration of another embodiment of the process of this invention.

In yet another alternate embodiment of the invention, the vacuum residuum feed is caused to separate into three separate products comprising asphaltenes, resins and oils, respectively. Turning now to FIG. 5, the vacuum residuum feed is introduced into an upper portion 112 of a first separation zone 118 through a conduit 110. The feed is contacted by a solvent introduced into a lower portion 116 of first separation zone 118 through a conduit 114. The first separation zone 118 is maintained at an elevated temperature and pressure to effect a separation of the feed-solvent mixture into a first light phase comprising resins, oils and solvent and a first heavy phase comprising asphaltenes and some solvent.

The particular conditions of temperature and pressure are selected to provide a solvent density within first separation zone 118 such that a fluid-like heavy phase is caused to separate from the remaining solvent-rich light phase. More particularly, first separation zone 118 is maintained at a temperature level in the range of from about 150 degrees F. to above the critical temperature of the solvent. The pressure level of first separation zone 118 is maintained at least equal to the vapor pressure of the solvent when zone 118 is maintained at a temperature below the critical temperature of the solvent and at least equal to the critical pressure of the solvent when maintained at a temperature equal to or above the critical temperature of the solvent.

The first heavy phase is withdrawn from first separation zone 118 through a conduit 124, reduced in pressure by passage through a pressure reduction valve 126 interposed in conduit 124 and introduced into a steam stripper 128. Preferably, the pressure level of the first heavy phase is reduced to a level of from about 0 to 50 psig. Steam is introduced into steam stripper 128 to vaporize the solvent present through a conduit 130. The asphaltenes in the first heavy phase settle and collect in the bottom portion of steam stripper 128. The asphaltenes are withdrawn from steam stripper 128 through a conduit 132 for recovery. The vaporized solvent and any fine particles of asphaltenes that form upon pressure reduction rise with the steam to an upper portion of steam stripper 128 and are withdrawn through a conduit 134.

The mixture of vaporized solvent, steam and any fine particle size asphaltenes is introduced into a second separation zone 136. In second separation zone 136, the mixture is countercurrently contacted with a portion of a light phase product comprising oils or oils and resins separated from the vacuum residuum feed that is introduced through a conduit 142 into an upper portion 135 of second separation zone 136. The light phase product scrubs tha fine particle size asphaltenes from the mixture and then collects within a lower portion 137 of second separation zone 136.

The light phase product, including the fine particles of asphaltenes, if any, are withdrawn from second separation zone 136 through a conduit 138. The withdrawn steam in conduit 138 can be recycled for re-treatment in the process or otherwise treated for disposal. At least a portion of the material in conduit 138 can be withdrawn through a conduit 140 for recycle to conduit 142.

The remainder of the mixture comprising vaporized solvent and steam is withdrawn from second separation zone 136 through a conduit 144 and introduced into a solvent condenser 146. The vaporized solvent and steam are condensed into a liquid mixture substantially free of any fine particles of feed material. The liquid mixture then is withdrawn from solvent condenser 146 through a conduit 156 and introduced into a solvent-water separation zone 158.

In separation zone 158 the solvent is separated from the water and withdrawn through a conduit 162 for storage in a solvent surge vessel 164 and subsequent recycle in the process through a conduit 196. The separated water is withdrawn from separation zone 158 through a conduit 160 and can be sewered or otherwise treated to permit disposal.

The first light phase formed in first separation zone 118 is withdrawn therefrom through a conduit 120 and introduced into a third separation zone 122. In third separation zone 122, the first light phase is caused to separate into a third light phase comprising oils and solvent and a third heavy phase comprising resins and some solvent through control of the temperature and pressure within zone 122. More particularly, third separation zone 122 is maintained at a temperature level greater than the temperature level in first separation zone 118. The pressure level of third separation zone 122 is maintained at least equal to the vapor pressure of the solvent when zone 122 is maintained at a temperature below the critical temperature of the solvent and at least equal to the critical pressure of the solvent when maintained at a temperature equal to or above the critical temperature of the solvent.

The third heavy phase is withdrawn from third separation zone 122 through a conduit 166, reduced in pressure by passage through a pressure reduction valve 168 interposed in conduit 166 and introduced into a steam stripper 170. The pressure reduction of the third heavy phase causes at least a portion of the solvent present in the third heavy phase to vaporize.

Steam is introduced into steam stripper 170 through a conduit 172 to vaporize at least a portion of any solvent remaining dissolved in the resins. The steam and vaporized solvent rise to an upper portion of steam stripper 170 while the resins collect in a lower portion of steam stripper 170. The resins then are withdrawn through a conduit 174 for recovery.

In the event that the pressure reduction of the third heavy phase results in the formation of fine particle size resins in the vaporized solvent, the mixture of vaporized solvent, steam and fine particle size resins is withdrawn from steam stripper 170 through a conduit 176 for introduction into second separation zone 136 for particle removal and solvent recovery.

In an alternate embodiment, the mixture can be introduced into a separate separation zone (not shown) and then condensed for solvent recovery.

In the event that the mixture contains no fine particle size resins, the mixture in conduit 176 can be introduced into solvent condenser 146 rather than second separation zone 136 (not shown). The stream in conduit 176 also could be introduced into a separate solvent condenser and solvent-water separation zone (not shown) for recovery.

The third light phase formed in third separation zone 122 is withdrawn therefrom through a conduit 178 and introduced into a fourth separation zone 180. In fourth separation zone 180, the third light phase is caused to separate into a fourth light phase comprising solvent and a fourth heavy phase comprising oils and some solvent through control of the temperature and pressure within zone 180. More particularly, in one embodiment, fourth separation zone 180 is maintained at a temperature level greater than the temperature level in third separation zone 122. The pressure level of fourth separation zone 180 is maintained at least equal to the vapor pressure of the solvent when zone 180 is maintained at a temperature below the critical temperature of the solvent and at least equal to the critical pressure of the solvent when maintained at a temperature equal to or above the critical temperature of the solvent.

The fourth light phase comprising solvent is withdrawn from fourth separation zone 180 through a conduit 194 for recycle in the process.

The fourth heavy phase is withdrawn from fourth separation zone 180 through a conduit 182, reduced in pressure by passage through a valve 184 interposed in conduit 182 and introduced into a steam stripper 186. The pressure reduction of the fourth heavy phase causes at least a portion of the solvent present in the fourth heavy phase to vaporize.

Steam is introduced into steam stripper 186 through a conduit 188 to vaporize at least a portion of any solvent remaining dissolved in the oils. The steam and vaporized solvent rise to an upper portion of steam stripper 186 while the oils collect in a lower portion of steam stripper 186. The oils then are withdrawn from steam stripper 186 through a conduit 190 for recovery.

In the event that the pressure reduction of the fourth heavy phase results in the formation of fine particle size oils in the vaporized solvent, the mixture of vaporized solvent, steam and fine particles is withdrawn from steam stripper 186 through a conduit 192 for introduction into second separation zone 136 for particle removal and solvent recovery or otherwise treated in the manner described for the stream in conduit 176.

In the event that the mixture contains no fine particles of oils, the mixture can be introduced directly into solvent condenser 146 rather than second separation zone 136 or otherwise treated to recover the solvent.

Thus, any fine particle size asphaltenes, resins or oils contained in the vaporized solvent separated from the asphaltene, resin and oil products can be removed from the vaporized solvent prior to condensation of the solvent to thereby avoid carry-over of the particles into the solvent recovery apparatus.

To illustrate the present invention and not by way of limitation, the following Examples are provided.

EXAMPLE I

Two tests are performed to determine the effect of the present invention upon a bituminous separation process.

In the first test, a feed comprising a vacuum residuum is contacted and admixed with a solvent comprising pentane in an amount sufficient to provide a solvent to feed ratio, by volume of 12:1. The feed mixture continuously is introduced into first separation zone 18 which is maintained at a temperature level of about 425 degrees F. and a pressure of about 650 psig. The feed mixture separates into a first light phase and a first heavy phase comprising asphaltenes, resins and solvent. The first heavy phase continuously is withdrawn from separation zone 18, passed through pressure reduction valve 26 and introduced into steam stripper 28 at a pressure of about 15 psig. Steam is introduced into the lower portion of steam stripper 28 at a pressure of 225 psig. The steam strips solvent remaining in the asphaltenes and resins and the vaporized solvent and steam are withdrawn and introduced directly into solvent condenser 46. The solvent and steam are condensed and then are introduced into solvent-water separator 58. After 2 hours of continuous operation, solvent-water separator 58 is inspected and is found to contain a deposit of fine particle size asphaltenes and resins which has collected therein and substantially blocked the water drain conduit 60.

A second test then is run, in accordance with the process of this invention, after second separation zone 36 is installed in the conduit between steam stripper 28 and solvent condenser 46 (as shown in FIG. 1) and solvent-water separator 58 is cleaned. The operating conditions are maintained as in the first test. Light phase product is introduced into the upper portion of second separation 36 zone in a ratio by weight of light phase to vaporized solvent and steam of about 1:10. After 48 hours process operation is discontinued and the interior of solvent-water separator 58 is inspected. The solvent-water separator is found to contain no new deposit of asphaltenes and resins.

EXAMPLE II

Two tests are performed to determine the effect of the present invention upon another bituminous separation process.

In the first test, a feed comprising a vacuum residuum is contacted and admixed with a solvent comprising pentane in an amount sufficient to provide a solvent to feed ratio, by volume of 12:1. The feed mixture continuously is introduced into first separation zone 18 which is maintained at a temperature level of about 425 degrees F. and a pressure of about 650 psig. The feed mixture separates into a first light phase and a first heavy phase comprising asphaltenes and solvent. The first heavy phase continuously is withdrawn from first separation zone 18 and passed through pressure reduction valve 26 and introduced into steam stripper 28 at a pressure of about 15 psig. Stream is introduced into steam stripper 28 at a pressure of 225 psig. The steam strips solvent remaining in the asphaltenes and the vaporized solvent and steam are withdrawn and introduced directly into solvent condenser 46. The solvent and steam are condensed and the resultant liquid stream then is introduced into solvent-water separator 58. After 2 hours of continuous operation, solvent-water separator 58 is inspected and is found to contain a deposit of fine particle size asphaltenes which has collected therein.

A second test then is run, in accordance with the process of this invention, after second separation zone 36 is installed in the conduit between the steam stripper and the solvent condenser (as shown in FIG. 1) and solvent-water separator 58 is cleaned. The operating conditions are maintained as in the first test. Light phase product is introduced into the upper portion of second separation zone 36 in a ratio by weight of light phase to vaporized solvent and steam of about 1:10. After 48 hours of continuous process operation, the solvent-water separator 58 is inspected. The solvent-water separator is found to contain no new deposit of asphaltenes.

EXAMPLE III

Two tests are performed to determine the effect of the present invention upon yet another bituminous separation process.

In the first test, a feed comprising vacuum residuum is contacted and admixed with a solvent comprising pentane in an amount sufficient to provide a solvent to feed ratio, by volume of 12:1. The feed mixture continuously is introduced into a first separation zone which is maintained at a temperature level of about 425 degrees F. and a pressure of about 650 psig. The feed mixture separates into a first light phase comprising resins, oils and solvent and a first heavy phase comprising asphaltenes and solvent. The first light phase continuously is withdrawn from the first separation zone and introduced into another separation zone. This separation zone is maintained at a temperature level of about 450 degrees F. and a pressure of about 630 psig. The first light phase separates into another light phase and another heavy phase comprising resins, oils and some solvent. The heavy phase is withdrawn from the separation zone, passed through a pressure reduction valve and introduced into a steam stripper at a pressure of about 15 psig. Steam is introduced into the lower portion of the steam stripper at a pressure of 225 psig. The steam strips solvent remaining in the resins and oils and the vaporized solvent and steam are withdrawn and introduced into a solvent condenser. The solvent and steam are condensed and then are introduced into a solvent-water separator. After 2 hours of continuous operation, the solvent-water separator is inspected and is found to contain a deposit of fine particle size material comprising resins and some oil which has collected therein.

A second test then is run, in accordance with the process of this invention, after another separation zone is installed in the conduit between the steam stripper and the solvent condenser and the solvent-water separator is cleaned. The operating conditions are maintained as in the first test. An oil fraction separated from the light phase product by fractionation is introduced into the upper portion of the additional separation zone in a ratio by weight of oil to vaporized solvent and steam of about 1.10. After 48 hours of continuous process operation the interior of the solvent-water separator is inspected. The solvent-water separator is found to contain no new deposit of resins and oils.

The foregoing Examples clearly illustrate the benefit which is to be derived from the use of the present invention. The present invention permits continuous operation of the bituminous separation process by scrubbing the fog or mist of fine particles from the vaporized solvent to thereby avoid carry-over of the fine particles into the solvent recovery apparatus of the process.

The term "bituminous material" as used herein means pyrogenous bitumens and native bitumens, one or more fractions or components thereof, products obtained by treating these materials or one or more of their components or fractions with air or another oxygen containing gas in the presence or absence of catalysts and products obtained by otherwise treating these materials. The pyrogenous bitumens include heavy or very low API gravity petroleum crudes, reduced crudes, either steam or vacuum refined, hard and soft wood pitches, coal tar residues, cracked tars, tall oil and the like. The native bitumens include gilsonite, wurtzilite, albertite and native asphalt, for instance, Trinidad asphalt and the like. Suitable catalysts include, for example, phosphorous pentoxide, ferric chloride, cobaltic salts and the like. The term "otherwise treating" as used herein includes, for example, condensation of asphalt-type material in the presence of a suitable agent to produce heavier or more complex materials. Examples of a suitable treating agent are catalysts of the Friedel-Craft type.

The term "solvent" as used herein means a fluid comprising at least one member selected from the group consisting of: aromatic hydrocarbons having normal boiling points below 350 degrees F., such as benzene, toluene, o-, m- and p-xylene and isopropyl benzene; paraffin hydrocarbons containing from 3 through 9 carbon atoms, such as propane, butane, pentane, hexane, heptane, octane and nonane; and mono-olefin hydrocarbons containing from 4 to 8 carbon atoms, such as butene, pentene, hexene, heptene and octene; and alcohols containing from 3 to 9 carbon atoms and other similar fluids.

While the present invention has been described with respect to what at present are preferred embodiments thereof, it will be understood, of course, that certain changes, substitutions, modifications and the like may be made therein without departing from its true scope as defined in the appended claims.

What is claimed is:

1. A process comprising:

separating an admixture comprising a fluid-like bituminous material and a solvent in a first separation zone into at least a fluid-like first light phase comprising a portion of said bituminous material and solvent and a fluid-like first heavy phase comprising the remainder of said bituminous material and solvent by maintaining the mixture at an elevated temperature and pressure;

reducing the pressure on said first heavy phase to vaporize at least a portion of the solvent present therein and form a mixture of fluid-like bituminous material in association with said vaporized solvent together with undesired fine particles of bituminous material dispersed therein;

introducing said mixture into a steam stripper;

introducing steam into said steam stripper to contact said mixture to vaporize at least a portion of any nonvaporized solvent remaining therein to form at least one stream comprising said fluid-like bituminous material and one other stream comprising steam and vaporized solvent together with said fine particles of bituminous material dispersed therein;

introducing said stream comprising said steam, vaporized solvent and fine particles of bituminous material into a second separation zone;

contacting said stream introduced into said second separation zone with a stream comprising at least a portion of said fluid-like first light phase to scrub said fine particles of bituminous material from said vaporized solvent; and recovering said solvent from said second separation zone substantially free of any fine particle size bituminous material.

2. The process of claim 1 wherein the solvent comprises at least one member selected from the group consisting of aromatic hydrocarbons having normal boiling points below 350 degrees F., paraffin hydrocarbons containing from 3 through 9 carbon atoms, monoolefin hydrocarbons containing from 4 to 8 carbon atoms and alcohols containing from 3 through 9 carbon atoms.

3. The process of claim 1 wherein the elevated temperature and pressure are defined further as a temperature in the range of from about 150 degrees F. to about the critical temperature of the solvent and a pressure at least equal to the vapor pressure of the solvent when at a temperature below the critical temperature of the solvent and at least equal to the critical pressure when at a temperature equal to or above the critical temperature of the solvent.

4. The process of claim 1 wherein the contacting of the stream comprising vaporized solvent and steam with the stream comprising a portion of the fluid-like light phase in the second separation zone is effected countercurrently.

5. A process comprising:

separating an admixture comprising (i) a residuum comprising asphaltenes, resins and oils and (ii) a solvent in a first separation zone into a first light phase comprising oils and solvent and a first heavy phase comprising asphaltenes, resins and some solvent by maintaining the mixture at an elevated temperature and pressure;

reducing the pressure on said first heavy phase to vaporize at least a portion of the solvent present therein and form a mixture of fluid-like asphaltenes and resins in association with said vaporized solvent together with undesired fine particles of asphaltenes and resins dispersed therein;

introducing said mixture into a steam stripper;

introducing steam into said steam stripper to contact said mixture to vaporize at least a portion of any nonvaporized solvent remaining therein to form at least one stream comprising said fluid-like asphaltenes and resins and one other stream comprising said steam and vaporized solvent together with said fine particles of asphaltenes and resins dispersed therein;

introducing said stream comprising said steam, vaporized solvent, and fine particles of asphaltenes and resins into a second separation zone;

contacting said stream introduced into said second separation zone with a stream comprising at least a portion of said first light phase to scrub said fine particles of asphaltenes and resins from said vaporized solvent; and recovering said solvent from second separation zone substantially free of any fine particle size asphaltenes and resins.

6. The process of claim 5 wherein the solvent comprises at least one member selected from the group consisting of aromatic hydrocarbons having normal boiling points below 350 degrees F., paraffin hydrocarbons containing from 3 through 9 carbon atoms, monoolefin hydrocarbons containing from 4 to 8 carbon atoms, and alcohols containing 3 through 9 carbon atoms.

7. The process of claim 5 wherein the elevated temperature and pressure of the first separation zone are defined further as a temperature in the range of from about 150 degrees F. to above the critical temperature of the solvent and a pressure at least equal to the vapor pressure of the solvent when at a temperature below the critical temperature of the solvent and at least equal to the critical pressure of the solvent when at a temperature equal to or above the critical temperature of the solvent.

8. The process of claim 5 wherein the contacting in the second separation zone is effected countercurrently.

9. A process comprising:

separating an admixture comprising (i) a residuum comprising asphaltenes, resins and oils and (ii) a solvent in a first separation zone into a first light phase comprising resins, oils and solvent and a first heavy phase comprising asphaltenes and some solvent by maintaining the mixture at an elevated temperature and pressure;

reducing the pressure on said first heavy phase to vaporize at least a portion of the solvent present therein and form a mixture of fluid-like asphaltenes in association with said vaporized solvent together with undesired fine particles of asphaltenes dispersed therein;

introducing said mixture into a steam stripper;

introducing steam into said steam stripper to contact said mixture to vaporize at least a portion of any nonvaporized solvent remaining therein to form at least one stream comprising said fluid-like asphaltenes and one other stream comprising said stream and vaporized solvent together with said fine particles of asphaltenes dispersed therein;

introducing said stream comprising said steam, vaporized solvent, and fine particles of asphaltenes into a second separation zone;

contacting said stream introduced into said second separation zone with a stream comprising at least one member selected from the group consisting of resins and oils to scrub said fine particles of asphaltenes from said vaporized solvent;

recovering said solvent from said second separation zone substantially free of any fine particles of asphaltenes;

introducing said first light phase into a third separation zone maintained at a temperature level higher than the temperature in said first separation zone and at an elevated pressure to effect a separation of said first light phase into a third light phase comprising oils and solvent and a third heavy phase comprising resins and some solvent;

reducing the pressure on said third heavy phase to vaporize at least a portion of the solvent present therein and form a mixture of fluid-like resins in association with said vaporized solvent together with undesired fine particles of resins dispersed therein;

introducing said mixture of fluid-like resins in association with said vaporized solvent and fine particles of resins into a steam stripper;

introducing steam into said steam stripper to contact said fluid-like resins to vaporize at least a portion of any nonvaporized solvent remaining in association therewith to form at least one stream comprising said fluid-like resins and one other stream comprising said steam and vaporized solvent together with said fine particles of resins dispersed therein;

introducing said stream comprising said steam, vaporized solvent and fine particles of resins into a fourth separation zone;

contacting said stream introduced into said fourth separation zone with a stream comprising oils to scrub said fine particles of resins from said vaporized solvent; and recovering said solvent from said fourth separation zone substantially free of any fine particle size resins.

10. The process of claim 9 wherein the solvent comprises at least one member selected from the group consisting of aromatic hydrocarbons having normal boiling points below 350 degrees F., paraffin hydrocarbons containing from 3 through 9 carbon atoms, monoolefin hydrocarbons containing from 4 to 8 carbon atoms, and alcohols containing 3 through 9 carbon atoms.

11. The process of claim 9 wherein the elevated temperature and pressure of the first separation zone are defined further as a temperature in the range of from about 150 degrees F. to above the critical temperature of the solvent and a pressure at least equal to the vapor pressure of the solvent when at a temperature below the critical temperature of the solvent and at least equal to the critical pressure of the solvent when at a temperature equal to or above the critical temperature of the solvent.

12. The process of claim 9 wherein the contacting in the second separation zone is effected countercurrently.

13. The process of claim 9 wherein the contacting in the fourth separation zone is effected countercurrently.

14. The process of claim 9 wherein the second separation zone and fourth separation zone comprise the same separation zone.

15. The process of claim 9 wherein the temperature and pressure in the third separation zone are defined further as a temperature above the critical temperature of the solvent and a pressure above the critical pressure of the solvent.

* * * * *